United States Patent [19]

McIntosh

[11] 3,991,870

[45] Nov. 16, 1976

[54] REPLACEABLE COMPOSITE WIRE GUIDE ASSEMBLY

[75] Inventor: Robert A. McIntosh, Nashua, N.H.

[73] Assignee: Centronics Data Computer Corporation, Hudson, N.H.

[22] Filed: June 6, 1975

[21] Appl. No.: 584,510

[52] U.S. Cl. ..... 197/1 R; 101/93.05; 308/3.9

[51] Int. Cl.[2] ..... B41J 3/04

[58] Field of Search ..... 197/1 R; 101/93.04, 101/93.05; 308/1 R, 3.9

[56] References Cited

UNITED STATES PATENTS

| | | | |
|---|---|---|---|
| 3,584,575 | 6/1971 | Distl | 197/1 R X |
| 3,802,543 | 4/1974 | Howard | 197/1 R |
| 3,820,643 | 6/1974 | Priebs et al. | 197/1 R |

*Primary Examiner*—Ralph T. Rader

[57] ABSTRACT

The print head in a high-speed printer of the dot matrix type is provided with a bearing comprising an element fixedly attached to the front wall of a plastic block. The element is made of a material substantially harder than plastic, such as metal or a jewel. Guide passages extending through the element are aligned with similar guide passages in the plastic block and are axially directed towards a paper document. The forward end of the print head is provided with slots for receiving the plastic block which may be releaseably secured into position by means of a substantially U-shaped compliant brad, greatly simplifying both assembly and disassembly thereof.

20 Claims, 9 Drawing Figures

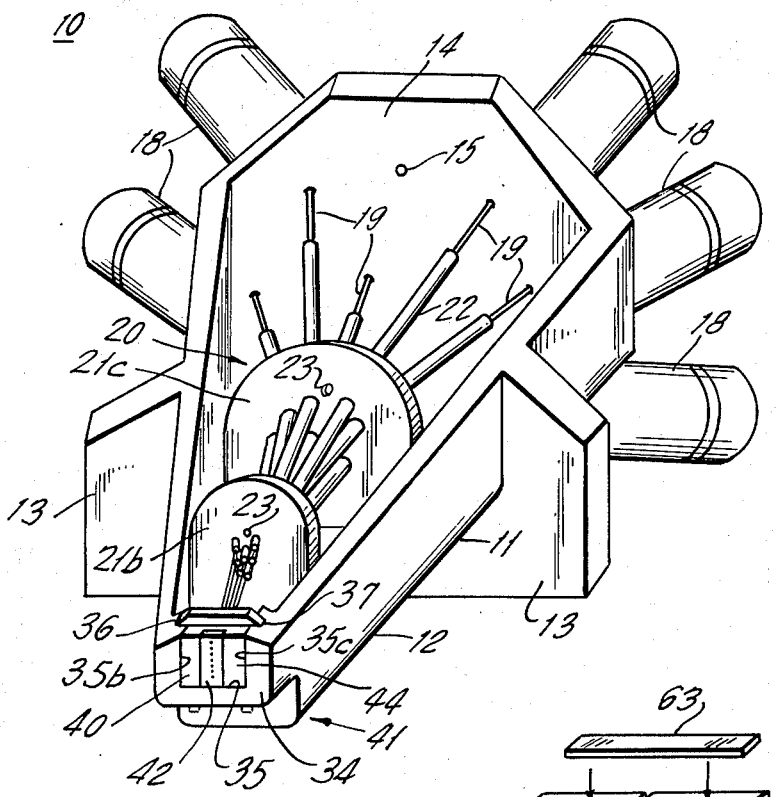
FIG. 1a.
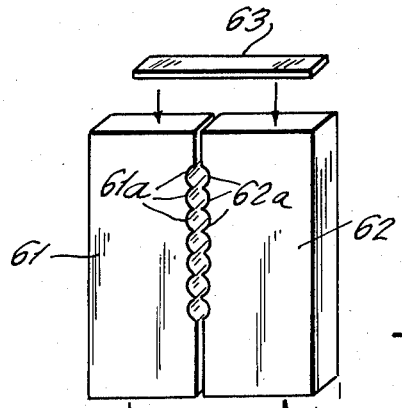
FIG. 6.
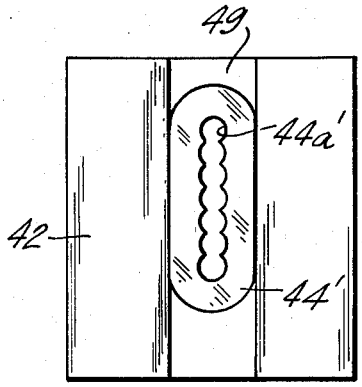
FIG. 7
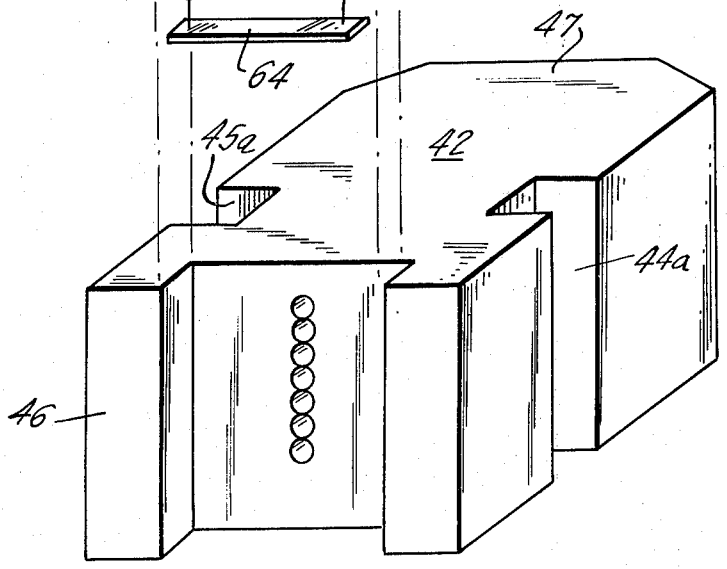

REPLACEABLE COMPOSITE WIRE GUIDE ASSEMBLY

BACKGROUND OF THE INVENTION

The present invention generally relates to a print head used in a high-speed printer of the dot matrix type and, more particularly, to an improved composite bearing releasably attached to the front of the print head for accurately guiding the print wires toward the paper document.

The dot-matrix printing technique is characterized by allocating to each character a dot matrix having a plurality of closely spaced columns and rows. A particular character is generated by printed selected dots within the matrix.

In high-speed printers, for which the present invention is particularly well-suited, the dot matrix is delineated as a column of print wires moved along a paper document. The number of dots within a column as well as the number of columns per character are a matter of choice. One embodiment, for example, forms a character from five columns of seven dots per column, forming each character within a 5×7 dot matrix. At each column location, the tips of the selected print wires are driven against a paper document through an inked ribbon to generate the requisite dots, and the print head continues to move to the next column location.

The print quality is critically dependent on establishing and maintaining a precise point of impact for each wire. The impacting tips of the print wires must be closely spaced and accurately aligned along an imaginary vertical line. Any misalignment produces distortions in the printed characters since the dots then are not printed in the designated positions within the matrix.

The print head component directly responsible for properly aligning and accurately guiding the print wires is a bearing mounted on the print head in close proximity to the inked ribbon and paper document. A plurality of substantially parallel, vertically aligned and closely spaced passages extending through the bearing are adapted to slidably accommodate the print wires. Each wire fits snugly in each passage so as to experience only axial movement, though the fit is not so snug as to hinder the reciprocating movement. The wires are thus restricted, particularly because of the short travel involved, to move in the axial direction of the passages.

Aside from the accurate alignment of the bearing passages in order to precisely locate the print wires, the characteristics of a bearing should include: 1) long operating life, 2) quick and easy replaceability, and 3) low cost. A bearing must be able to maintain print wire alignment over a substantial period of usage. A satisfactory bearing should typically provide accurate print wire alignment over tens of millions of reciprocating operations. These operations occur at high acceleration rates in order to print at rates far in excess of 100 characters per second. The high rate of acceleration generates sidewise forces transmitted by the print wires to the bearing during printing. Consequently, a bearing which can maintain accurate alignment of the print wires under extended usage while being subjected to such sidewise forces is highly desirable. Also, since a bearing, like any mechanical part, has a limited life, its mode of attachment to the print head should take into consideration the need for future replacement. Therefore, its attachment should not be permanent but rather it should be easily replaceable.

Bearings available prior to the present invention have typically been made of either one of two materials, with neither being satisfactory in meeting all of the above-discussed bearing requirements. A jewel bearing, typically a ruby or a sapphire, while being satisfactorily resistant to sliding motion wearing, is liable to fracture and chip due to the above discussed sidewise forces imparted thereto by the print wires. In addition, a jewel bearing is rather expensive. To keep the cost of a jewel bearing from being even higher, only a minimum amount of machining, primarily to fashion the passages, is utilized. Consequently, the bearing contains no surface which can be used to form an easily releasable attachment. The only practical way of affixing the relatively flat and substantially rectangular shaped bearing to the print head is with a permanent attachment as, for example, with epoxy. Replacement of the bearing is, therefore, rather awkward and time-consuming.

A plastic bearing, on the other hand is relatively inexpensive and can economically be formed into a shape adapted for facilitating its replacement. However, its operating life is not as long as a jewel bearing.

Accordingly, it is the prime object of the present invention to provide an improved print wire bearing for a high-speed dot matrix printer.

Another object of the present invention is to provide a composite print wire bearing for a high speed dot matrix printer having an increased operating life.

Another object of the present invention is to provide an easily replaceable print wire bearing for a high speed dot matrix printer.

In accordance with these objects, the print head in a high-speed dot matrix printer is provided with a first somewhat compliant bearing releasably mounted to the print head housing. A "hard" element is fixedly secured to the front face of the first bearing. The aforesaid element is made of a material substantially harder than plastic, such as metal or a jewel. Guide means extending through the element are aligned with guide passages in the plastic bearing. The forward end, or nose, of the print head is provided with a pair of guide slots for receiving the plastic bearing which may be locked into position by means of a substantially U-shaped compliant brad which greatly simplifies both assembly and disassembly thereof.

In the above described bearing, the element serves as the "fine" alignment wire guide since it is adjacent the inked ribbon and the print wires follow the paths of its guideway, while the plastic block serves as a "coarse" alignment guide. Since the plastic block is relatively compliant and comprises the bulk of the bearing, it absorbs substantially all of the sidewise forces imparted to the bearing by the print wires. The useful life of the insert which experiences an insignificant amount of the sidewise forces is thereby increased with the overall effect being that of substantially increasing the useful life of the composite bearing over previous designs despite wear in the plastic block passages.

To the accomplishment of the above, as well as other objects as will hereinafter appear, the present invention relates to the construction of a composite print wire guide bearing in a print head for a high-speed dot matrix printer, as defined in the appended claims and as described in this specification, taken together with the accompanying drawings, in which:

FIG. 1 is a front perspective view of a print head constructed in accordance with the present invention;

Figure 4:
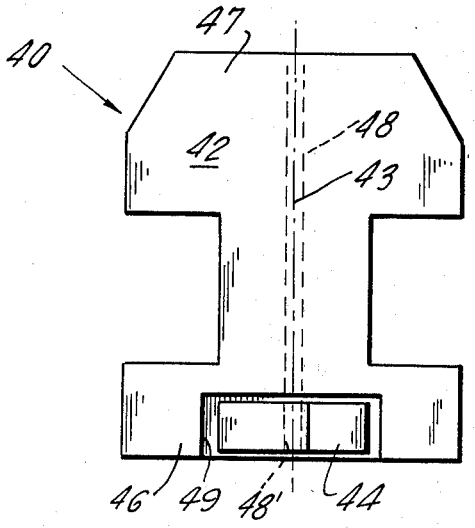
FIG. 4 is a top plan view of a bearing formed in accordance with the present invention.
Figure 5A:
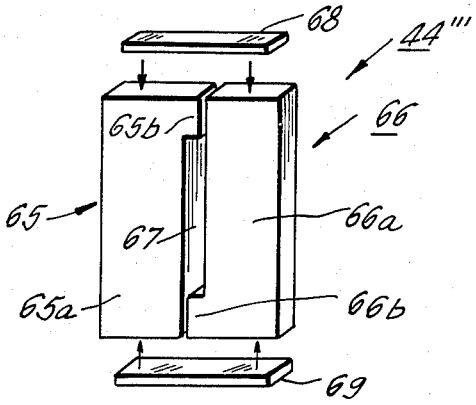
Figure 4A:
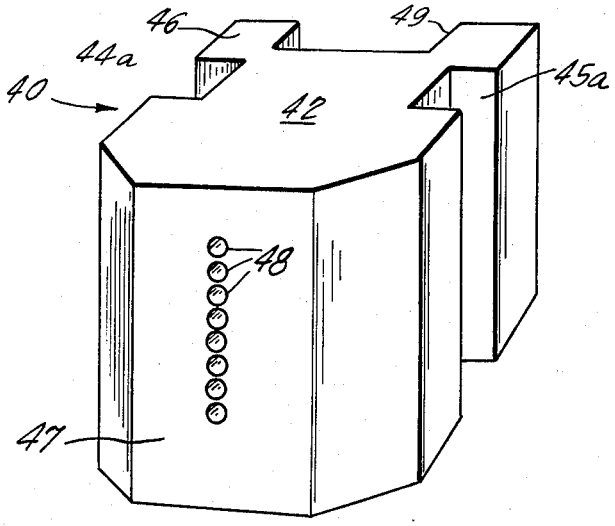
Figure 5:
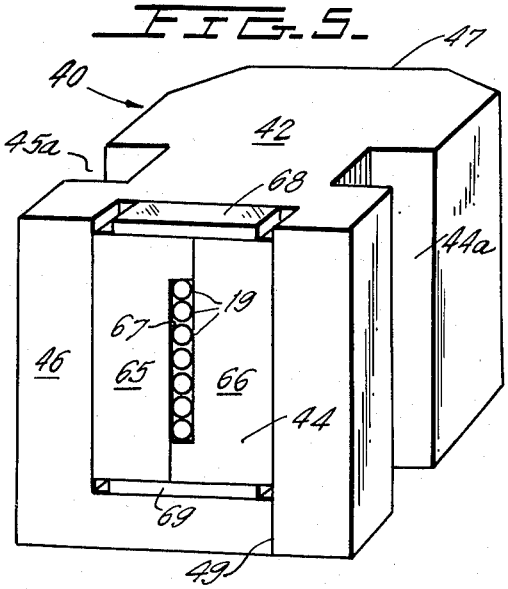

FIG. 4*a* is a rear perspective view of the bearing of FIG. 4;

FIGS. 5 and 5*a* are front perspective views of a bearing formed in accordance with the present invention;

FIG. 6 is an exploded front perspective view of another embodiment of a composite bearing in accordance with the present invention; and FIG. 7 is a front elevational view of still another embodiment of a composite bearing in accordance with the present invention.

DETAILED DESCRIPTION OF THE INVENTION

FIG. 1 shows a print head assembly 10 comprised of a one-piece die cast housing member 11 having a base 12 provided with outwardly extending flanges 13 for mounting member 11 on a movable carriage (not shown). The rear surface of member 11 is provided with an upwardly projecting wall 14 having a plurality of tapped apertures 15. The rearwardly directed surface of wall 14 has a truncated pyramidal configuration and the apertures 15 extending through rear wall 14 are preferably aligned so as to be substantially perpendicular to their associated mounting surfaces. Each of the tapped apertures 15 threadedly engages the threaded stem (not shown) of a solenoid assembly 18. Each solenoid has a slender print wire 19 projecting through the forward opening of each solenoid assembly 18 and an aperture 15 and extending into and through the hollow interior of member 11.

An intermediate guide assembly 20 is mounted within member 11 and is comprised of upwardly extending guide portions 21*b* and 21*c* securely attached to member 11 in any well known manner. Each of the guide portions 21*b* and 21*c* is provided with a plurality of apertures 23 for receiving curved hollow guide tubes 22. Guide tubes 22 are permanently affixed to guide arms 21*b* and 21*c* by a suitable epoxy. Each print wire 19 extends through an associated one of the curved hollow guide tubes 22 and through a centrally located opening 35 in forward wall 34 of member 11.

The print wires 19 loosely positioned within opening 35 must be firmly held in vertical alignment and accurately guided toward the paper document to print each column of the dot matrix. These tasks are performed by a composite bearing 40 mounted within opening 35 of member 11. Bearing 40 is comprised of block 42 and element 44. As shown in FIGS. 4 and 5, block 42 comprises the bulk of bearing 40 and has passages 48 extending therethrough along center line 43. The number of passages is dependent on the number of dots (and hence print wires provided for a dot column) which, in the exemplary matrix referred to above, is seven. Passages 48 are closely spaced and substantially parallel to each other, and are arranged along an imaginary vertical line. Insert 44 is elongated and relatively thin in comparison to the depth of block 42. The insert 44 contains passages 48' corresponding in number and aligned with passages 48 in block 42. Thus, passages 48 and 48' combine to form continuous passages extending from back wall 47 of block 42 to the front face of element 44.

"Hard" insert 44 is permanently and rigidly affixed to front wall 46 of member 11, for example, by cementing the insert to front wall 46 with a suitable epoxy. Though such an attachment can be made to the face of wall 46, a more reliable arrangement is used in the preferred embodiment. Since the bearing is adapted for use in a printer having a continuously moving print head (see U.S. Pat. No. 3,703,949), the insert 44 may be subjected to drag forces transmitted to it by the print wires 19 contacting the paper document as the print head is moving. Such a force may cause insert 44 to be damaged and/or moved away from wall 46 despite the epoxy attachment. Consequently, front wall 46 is provided with an elongated recess 49 adapted to snugly accommodate element 44. The element 44 is cemented within recess 49 by a suitable epoxy. The sidewalls of recess 9 serve to prevent any lateral movement of insert 44 to eliminate the possibility of its being misaligned.

Figure 2:
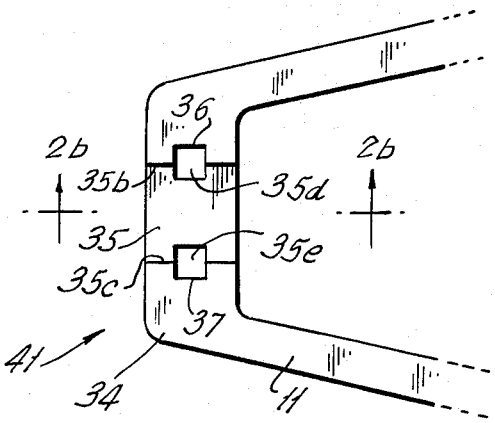
FIG. 2 is a top plan view showing the nose portion of the print head.
Figure 3:
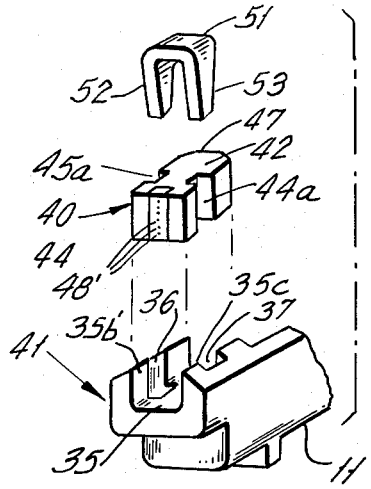
FIG. 3 is an exploded perspective view of the nose portion of the print head with an attached bearing.

The two most significant features of bearing 40 are its mode of attachment to member 11 and the materials comprising block 42 and insert 44. As to the former, the object is to simplify the replacement of bearing 40. To this end, upright side walls 35*b* and 35*c* of opening 35 in print head housing 11 are provided with vertically aligned slots 36 and 37, respectively (FIGS. 2 and 3). Slots 36 37 are aligned with holes 35*d* and 35*e* (FIG. 2) which extend through nose 41 to the underside of member 11. The vertical sides 44 and 45 of block 42 (see FIG. 3) are each provided with slots 44*a* and 45*a*, respectively. Bearing 40 is inserted in opening 35 and rests upon base 35*a*. In this position, slots 36 and 45*a* and slots 37 and 44*a* cooperatively form rectangular-shaped openings to receive the tapered arms 52 and 53 of a compliant U-shaped brad 50. A yoke 51 connecting tapered arms 52 and 53 to each other is positioned above bearing block 42 while the free ends of arms 52 and 53 extend into the openings 35*d* and 35*e* in member 11. Brad 50 is force-fitted into the openings until its yoke portion 51 engages block 42 to firmly secure block 40 to member 11.

Disassembly may be accomplished, quite simply, by placing the tip of a thin member, such as a knife or screwdriver, beneath the yoke 51 of brad to force it out of engagement with openings 35*d* and 35*d* and out of the above-mentioned rectangular-shaped openings formed between block 42 and nose 41. After brad 50 has been completely removed, bearing 40 may be lifted out of opening 35 and replaced by a new bearing which can be secured by brad 50 in the manner described above. Other attachment schemes can also be used. Some examples can be found in application Ser. No. 504,711 filed Sept. 10, 1974 and assigned to the assignee of this invention.

By using a particular arrangement of two materials well suited to cooperate with each other, a bearing with a substantially improved performance can be developed. For this reason I utilize a plastic for bearing block 42 and a jewel material or metal for insert 44 arranged in a manner wherein one compensates for the deficiencies of the other while retaining the advantages of both. Specifically, block 42 when made of plastic can be inexpensively formed into the desired shape by a molding or extrusion process. Thus, minimal machining is required to provide slots 44*a* and 45*a* to enable the easy replacement of bearing 40, as described above. Such is not the case when bearing 40 consists only of a jewel, as in the prior art. In addition, the compliant nature of plastic serves to absorb substantially all of the sidewise forces imparted to it by print wires 19. Since the bulk of the composite bearing is comprised of block 42, insert 44 is effectively isolated from the sidewise forces. Since a jewel is liable to fracture and chip when subjected to such forces, as discussed above, block 42 serves to substantially lengthen the useful life of a jewel insert 44. On the other hand, hard insert 44 is more resistant to sliding wear than plastic. Thus, although the plastic passages 48 be distorted, the composite bearing 40 is still useful and need not be replaced because passages 48' in insert 44 maintain accurate alignment of the print wires 19.

Pursuant to the above, it should be clear that block 42 and insert 44 complement each other. By having insert passages 48' act as the "fine" guide passages, composite bearing 40 remains useful despite wear in the secondary guide passages 48 of plastic block 42. Similarly, exposure of bearing 40 to significant and continuous sidewise forces is of little consequence to insert 44 due to the attenuation of such forces by plastic block 42 (due to its appreciable length in the direction of movement as compared with the thickness of hard insert 44). Moreoover, the advantages of a jewel type bearing are retained without the inconvenience associated with its replacement by using block 42 as an inexpensive yet effective and reliable means for removably attaching bearing 40 to member 11.

Various embodiments can be used for block 42 and insert 44, application Ser. No. 504,711 filed Sept. 10, 1974 discloses several plastic bearing embodiments and these are incorporated herein. FIGS. 4–7 show three insert embodiments.

FIG. 4*a* shows a rear perspective view of the plastic bearing 42 with the openings 48 provided along rear surface 47 for receiving the slender print wires which converge toward such openings, having been guided toward such convergence by the guide plates 21*b* and 21*c* and tube guides 22. The print wires extend the entire axial length of openings 48 and further extend into recess 49 in the front face of plastic bearing 42 where they enter into the openings provided in the "hard"insert 44.

One suitable "hard"insert 44' is shown in FIG. 7 as being formed of a substantially oval shape and having a plurality of substantially circular shaped openings 44*a'* which, as was described hereinabove, are aligned with the openings provided in plastic bearing 42.

FIG. 6 shows still another embodiment in which the "hard" insert 44'' is comprised of first and second jewel members 61 and 62, are substantially rectangular in shape and are each provided with substantially semi-circular slots 61*a* and 62 which when aligned in the manner shown in FIG. 6 cooperatively form substantially circular shaped openings for slidably receiving the reciprocating print wires 19 (shown, for example, in FIG. 1). In order to insure accurate alignment of the semi-circular grooves 61*a* and 62*a*, these members may be formed as a separate subassembly and by means of a pair of metal plates 63 and 64 may be accurately aligned relative to one another, the plates 63 and 64 being secured to the bearing members 61 and 62 by a suitable epoxy. As an alternative to the use of jewel plates such as ruby or saphire, a hardened metal such as water-hardened tool steel may be employed with equal success. The completed sub-assembly comprised of elements 61–64 may then be cemented into place within recess 49 of bearing member 42 by means of a suitable epoxy.

FIGS. 5 and 5*a* show another alternative embodiment 44''' for the "hard" insert which is comprised of first and second substantially L-shaped hardened metal plates 65 and 66 having long arm portions 65*a* and 66*a* respectively, and short arm portions 65*b* and 66*b*, respectively. The plates 65 and 66 are aligned in the manner shown best in FIG. 5*a* so as to form one narrow elongated opening 67 through which the print wires 19 slidably extend (note especially FIG. 5).

Plates 65 and 66 may be formed as a separate subassembly maintained in proper alignment by a pair of flat plates 68 and 69 joined to the upper and lower edges of plates 65 and 66 by suitable epoxy means. In both the embodiments of FIGS. 6 and 5–5*a*, the subassembly may be formed by extending the print wires through either the openings formed by semi-circular grooves 61*a*–62*a* or the elongated openings 67 to assure proper spacing between the plates forming each embodiment. With the plates in proper alignment and spacing, plates 68 and 69 may be joined thereto by the suitable epoxy means with the structure retained by suitable holding or jig means until the epoxy hardens. Plates 65 and 66 may alternatively be formed of a jewel material such as ruby or saphire, if desired. Substituting one narrow elongated opening 67 for the substantially circular-shaped openings shown in either FIGS. 6 or 7 is permissible since the plastic bearing with the holes molded therein assures alignment of all the print wires in the veretical position thereby allowing the hardened insert to experience only sliding forces. The "hard"inserts may be appreciably thinner than the jewel bearings employed in the prior art independently of the plastic bearing member since the plastic bearing member serves to provide at least "coarse" alignment of the print wires, as well as absorbing substantially all of the sidewise forces which may be generated during the time that the print wires undergo reciprocating movement under control of their solenoid assemblies.

If desired, the plates 63 and 64 of FIG. 6 or 68 and 69 of FIGS. 5 and 5*a* may be eliminated and the plate halves may be cemented to the recess provided in the front face of bearing 42 while the print wires are extended therethrough to obtain appropriate alignment. The one-piece "hard" insert of FIG. 7 may be formed of either a hardened metal or a suitable jewel material. The metal may preferably be hardened steel. The plastic bearings may be formed of thermoplastic acetal resin, polycarbonate, ethyl cellulose thermoplastic, polyvinyltetrafluoroethylene resin, thermoplastic nylon or thermoplastic polyester. These materials have been found to be quite tenacious and do not chip or crack or fray or wear away when rubbed by a rough surface. The above materials may also be preferably mixed with additives, including dry lubricant, glass, carbon fibers, Teflon fibers, molybdenum disulphide and the like, which materials provide the plastic bearings with a self-lubricating characteristic which is extremely advantageous for use as a print wire bearing due to the high speed repetative reciprocating action experienced by the print wires which are slidably received by the bearing, which action takes place typically under extremely long periods of use. The compliant characteristic of the plastic bearing greatly facilitates the ease of assembly and disassembly whereas materials such as ruby and sapphire are extremely hard and brittle and must be cemented within the print head housing by means of an epoxy and other suitable maaterial thereby making it highly impractical to remove and reassemble the jewel members resulting in a print head assembly which is impractical to repair.

In the mounted position of composite bearing 40, passages 48 are axially directed toward the paper document. Each print wire 19 is inserted into an associated passage 48 and 48'. The preferred arrangement is such that the forward tips of print wires 19 are flush with the front face of insert 44 when the solenoids 18 are deenergized. As such, print wires 19 cannot snag on anything, particularly the inked ribbon, as the print head is being moved yet only a minimum distance need be traversed to thereby increase the speed of a print cycle for each wire.

It will be apparent from the foregoing that the advantage of the present invention is achieved by providing a bearing comprised of two materials. One material having good sliding motion wear characteristics but poor resistance to breakage when subject to sidewise forces is insulated from such force by the second material. Similarly, with the second material having relatively poor sliding motion wear properties, it is made a secondary guide element while the first material is made the primary guide element. Moreover, an inexpensive attachment means is readily provided with the second material to facilitate the replacement of the bearing. Consequently, the two materials complement each other in compensating for each other's deficiencies while retaining the benefits of both.

While but a single embodiment of the present invention has been here specifically disclosed, it will be apparent that many variations may be made therein, all within the scope of the instant invention as defined in the following claims.

What is claimed is:

1. In a print head adapted for use in a high-speed printer of the dot-matrix type including a hollow housing having front and rear walls, said rear wall having a plurality of apertures and said front wall having an opening therein, a slender flexible print wire extending through each of said apertures to said front wall, magnetic means for selectively moving each of said print wires in reciprocating fashion to impact the free ends thereof against a paper document and guide means mounted within said housing intermediate said front and rear walls for guiding each print wire along a given arcuate path toward said front wall opening whereby said print wires converge inwardly towards said front wall opening and towards the central longitudinal axis of the print head, the improvement comprising:

a. a first bearing block received within said front wall opening, said block having front and rear faces and a plurality of substantially parallel vertically aligned passages therethrough, the axes of said passages being aligned transverse to said paper document;

b. a second bearing fixed to said block front face and having at least one passageway therethrough which is in alignment with the adjacent passages in said first bearing; said first and second bearings being formed of a relatively compliant material and a relatively hard material, respectively;

c. attachment means for releasably securing said first bearing to said housing to facilitate removal and replacement of said first and second bearings as a single unit; and d. said print wires being slidably received in said aligned passages of said first and second bearings for selective movement therein upon actuation of said magnetic means;

said first bearing being approximately the length of said front wall opening and greater in length than said second bearing measured in said axial direction whereby said block absorbs substantially all of the sidewise forces which may be generated during actuation of the print wires and maintains the forward ends of the print wires in axial alignment in the second bearing whereby said second bearing experiences substantially only sliding forces from said print wires.

2. The print head of claim 1, wherein said first bearing front face is provided with a recess therein with said block passages extending into said recess, said second bearing being snugly mounted within said recess.

3. The print head of claim 2, wherein said block is substantially longer than said second bearing measured along the axial direction of said passages and the thickness of said second bearing is substantially equal to the depth of said recess, the length of said first bearing being sufficient to align the front ends of the print wires with the longitudinal axis of the print head.

4. The print head of claim 1, wherein said first bearing is made of plastic and said second bearing is made of hardened metal.

5. The print head of claim 1, wherein said first bearing is made of plastic and said second bearing is a jewel.

6. The print head of claim 3, wherein said first bearing is made of plastic and said second bearing is made of hardened metal.

7. The print head of claim 3, wherein said first bearing is made of plastic and said second bearing is a jewel.

8. The print head of claim 1 wherein said second bearing comprises a pair of L-shaped plates arranged in abutting fashion to define a narrow elongated opening for guiding said print wires.

9. The print head of claim 8, wherein said plates are formed of hardened metal.

10. The print head of claim 8 further comprising a pair of thin flat substantial rectangular shaped plates secured to opposite parallel edges of said L-shaped plates to maintain the L-shaped plates in proper alignment.

11. The print head of claim 1, wherein said second bearing comprises a one-piece member of a hard material having a narrow elongated opening for slidably receiving all of said print wires.

12. The print head of claim 1, wherein said second bearing comprises a one-piece member of a hard material having a plurality of openings each being provided for slidably receiving one of said print wires; said openings being arranged with their centers aligned along an imaginary straight line.

13. The print head of claim 1, wherein said second bearing is comprised of a pair of thin plates of a hard material, said plates each having a plurality of substantially semi-circular shaped grooves arranged along one edge thereof;

said grooved edges being arranged adjacent one another with said semi-circular shaped grooves being aligned so as to coopepratively define substantially circular shaped openings.

14. The print head of claim 13, wherein said pair of plates are joined to one another, by means of a second pair of thin shaped plates cemented to opposite parallel ends of said grooved plates, said parallel ends being above and below said grooved edges.

15. The embodiment of claim 13 wherein said thin plates are formed of hardened metal.

16. The embodiment of claim 13 wherein said thin plates are formed of a jewel material.

17. In a print head adapted for use in a high-speed printer of the dot-matrix type including a hollow housing having front and rear walls, said rear wall having a plurality of apertures and said front wall having an opening therein, a print wire extending through each of said apertures to said front wall, means for selectively moving each of said print wires in reciprocating fashion to impact the free ends thereof against a paper document and guide means mounted within said housing intermediate said front and rear walls for guiding each print wire along a given path toward said front wall opening whereby said print wires converge towards said front wall opening, the improvement comprising:

a. a bearing block received within said front wall opening, said block having front and rear faces and a plurality of substantially parallel vertically aligned passages therethrough, the axes of said passages being aligned transverse to said paper document;

b. a second bearing fixed to said block front face and having at least one passageway therethrough which is in axial alignment with the passages in said block; said block and said second bearing being formed of a relatively compliant material and a relatively hard material, respectively;

c. attachment means for releasably securing said bearing block to said housing; and d. said print wires being slidably received in said aligned passages of said block and said second bearing for selective movement therein upon actuation of said motive means;

said block being greater in length than said second bearing measured in said axial direction to cause said block to absorb substantially all of the sidewise forces which may be generated by actuation of the print wires whereby said second bearing experiences substantially only sliding forces;

said housing front wall opening being open along one side thereof and defined by two parallel sidewalls and a base, and wherein said attachment means is comprised of slots extending vertically along said sidewalls, said first bearing having sides adjacent said sidewalls and vertical slots in said sides facing said sidewall slots to cooperatively define a rectangular shaped opening; a compliant U-shaped member having a yoke portion and a pair of arms extending therefrom, said arms being secured in said slots with said yoke and said arms embracing the slots and one surface of said first bearing intermediate said slots.

18. The print head of claim 17, wherein the free ends of said U-shaped member are force-fitted into said slots.

19. The print head of claim 17, wherein the arms of said U-shaped member taper toward their free ends.

20. The print head of claim 17, wherein said base opening is provided with two holes therethrough in alignment with said sidewall slots and the arms of said U-shaped member are force-fittingly received within said holes.

* * * * *